US008889086B2

(12) United States Patent
Viljoen et al.

(10) Patent No.: US 8,889,086 B2
(45) Date of Patent: Nov. 18, 2014

(54) SAMPLE TUBE HAVING PARTICULAR UTILITY FOR NUCLEIC ACID AMPLIFICATION

(75) Inventors: Hendrik J. Viljoen, Lincoln, NE (US); Scott E. Whitney, Lincoln, NE (US); Joel R. TerMaat, Lincoln, NE (US); Matthew R. Kreifels, Omaha, NE (US)

(73) Assignee: Streck, Inc., Lavista, NE (US)

( * ) Notice: Subject to any disclaimer, the term of this patent is extended or adjusted under 35 U.S.C. 154(b) by 0 days.

(21) Appl. No.: 13/452,419

(22) Filed: Apr. 20, 2012

(65) Prior Publication Data

US 2012/0269703 A1 Oct. 25, 2012

Related U.S. Application Data

(60) Provisional application No. 61/477,785, filed on Apr. 21, 2011.

(51) Int. Cl.

| | |
|---|---|
| ***B01L 3/14*** | (2006.01) |
| ***B01L 9/06*** | (2006.01) |
| ***B01L 3/00*** | (2006.01) |
| *B01L 7/00* | (2006.01) |

(52) U.S. Cl.

CPC ..... *B01L 3/50825* (2013.01); *B01L 2300/022* (2013.01); *B01L 2300/043* (2013.01); *B01L 2300/168* (2013.01); *B01L 7/52* (2013.01); *B01L 2300/123* (2013.01)

USPC ..... 422/549; 422/562

(58) Field of Classification Search

None

See application file for complete search history.

(56) References Cited

U.S. PATENT DOCUMENTS

| | | | | |
|---|---|---|---|---|
| 5,225,165 | A * | 7/1993 | Perlman | 422/548 |
| 5,353,186 | A | 10/1994 | Ruoss et al. | |
| 5,571,479 | A | 11/1996 | Koch | |

(Continued)

FOREIGN PATENT DOCUMENTS

| | | |
|---|---|---|
| EP | 2193845 | 6/2010 |
| WO | 2006/024879 | 3/2006 |

(Continued)

OTHER PUBLICATIONS

PCT Notification of Transmittal of the International Preliminary Report on Patentability dated Aug. 2, 2013; Appln. No. PCT/US2012/034506.

International Search Report & Written Opinion dated Aug. 16, 2012; Application No. PCT/US2012/034506.

*Primary Examiner* — Jill Warden

*Assistant Examiner* — Julie Tavares

(74) *Attorney, Agent, or Firm* — The Dobrusin Law Firm, PC

(57) ABSTRACT

An improved tube including a closure portion, a strap integrally connected to the closure portion and being configured for defining a living hinge, a body portion having a longitudinal axis and an outer wall generally circumscribing the longitudinal axis, and being integrally and hingedly connected with the closure portion by way of the strap. The body portion including a sample portion being generally elongated along the longitudinal axis and being configured for elastic deformation along a portion of its length, including in a direction that is generally transverse to the longitudinal axis so that at least a portion of the wall structure compressively and resiliently deforms and engages a wall defining an opening in a sample block of a polymerase chain reaction amplification device, and the first outer wall dimension of the sample portion reduces to a smaller second outer wall dimension.

20 Claims, 9 Drawing Sheets

(56) References Cited

U.S. PATENT DOCUMENTS

| | | | |
|---|---|---|---|
| 5,604,101 | A | 2/1997 | Hanley et al. |
| 5,721,136 | A | 2/1998 | Finney et al. |
| 5,863,791 | A | 1/1999 | Baldszun et al. |
| 5,958,349 | A | 9/1999 | Petersen et al. |
| 6,015,534 | A | 1/2000 | Atwood |
| 6,159,727 | A | 12/2000 | Bochkariov |
| 6,312,886 | B1 | 11/2001 | Lee et al. |
| 6,783,025 | B2 | 8/2004 | Lohn |
| 7,255,833 | B2 | 8/2007 | Chang et al. |
| 7,749,452 | B2 | 7/2010 | Brem et al. |
| 2002/0086417 | A1 * | 7/2002 | Chen ..... 435/287.3 |
| 2009/0155838 | A1 | 6/2009 | Hale |

FOREIGN PATENT DOCUMENTS

| | | | |
|---|---|---|---|
| WO | WO 2006024879 | A1 * | 3/2006 |
| WO | 2009/105499 | A1 | 8/2009 |
| WO | 2011086497 | | 7/2011 |

* cited by examiner

SAMPLE TUBE HAVING PARTICULAR UTILITY FOR NUCLEIC ACID AMPLIFICATION

CLAIM OF PRIORITY

The present application claims the benefit of the filing date of U.S. Provisional Patent Application No. 61/477,785, filed on Apr. 21, 2011, the contents of which is incorporated herein by reference in its entirety.

FIELD OF THE INVENTION

The present invention relates generally to containers, and more particularly to unique resilient polymeric sample tubes for nucleic acid amplification.

BACKGROUND OF THE INVENTION

There is a need for sample holders that are thermally efficient in the manner in which heat is delivered to a contained sample, removed from a contained sample, or both. This is particularly acute in the field of polymerase chain reaction amplification of nucleic acid (e.g., DNA amplification). In such applications, samples are exposed to a dynamic heating and cooling protocol. Successful amplification often relies upon time dependent heat transfer. As a result, the efficiency of such operations can be limited when the mass, volume, or length of heat transfer of a sample is such that it impedes heat transfer within it, and to and from it.

One approach to sample tubes for amplification of nucleic acid has been to employ glass capillaries. While useful, the risk of breakage during use and the inability to deform such glass tubes during an amplification process make the use of glass capillaries an undesirable option. Another approach has been to employ polymeric sample vessels. However, the polymeric material may not provide sufficient heat transfer to substances within the tubes and may also fail to provide sufficient elasticity to be compressed as necessary during the amplification process. Examples of such polymeric and glass sample holders include those in U.S. Pat. Nos. 5,225,165; 5,353,186; 5,571,479; 5,604,101; 5,721,136; 5,863,791; 5,958,349; 6,015,534; 6,159,727; 6,312,886; 6,783,025; 7,255,833; and 7,749,452.

There is thus a need for an improved polymeric sample tube that provides for both sufficient heat transfer and sufficient elasticity for use in amplification processes that require compression of the tube during use.

SUMMARY OF THE INVENTION

The present invention meets one or more of the above needs by providing in an improved tube, and particularly a miniature sample tube that comprises a closure portion (which itself may include a tab portion, and an adjoining plug portion), a strap integrally connected to the closure portion and being configured for defining a living hinge. The sample tube may further include a body portion having a longitudinal axis and an outer wall generally circumscribing the longitudinal axis, and being integrally and hingedly connected with the closure portion by way of the strap. The body portion may include a head portion that has an opening through which a sample is received and/or dispensed, and a sample portion having a first outer wall dimension and including a closed distal end. The sample portion may also include a wall structure that includes an outer wall and an inner wall structure that defines a hollow cavity within which the sample resides as a sample volume after it is received through the head portion.

The closed-ended hollow sample portion may be generally elongated along the longitudinal axis and may be configured for elastic deformation along at least a portion of its length. The sample portion may be deformable in a direction that is generally transverse to the longitudinal axis so that at least a portion of the wall structure compressively and resiliently deforms and engages a wall defining an opening in a sample block of a polymerase chain reaction amplification device. Upon deformation, the first outer wall dimension of the sample portion may be reduced to a smaller second outer wall dimension.

As will be seen, such a tube offers a unique approach to handling a material, and especially a biological sampler. It is seen that, particularly as employed for preparing biological samples for nucleic acid amplification, the material (e.g., the biological sample) can readily be introduced into the tube without significant surface resistance, while then allowing the heat exchange characteristics of the volume of the material to be altered by manipulation of the tube relative to a sample block of a thermocycler. That is, the mere insertion of the tube into such a sample block can cause the tube to deform elastically, so that the overall thickness of the sample material that is heated becomes thinner, and more efficient for heat exchange (as compared with its original volume).

DETAILED DESCRIPTION

Figure 2A:
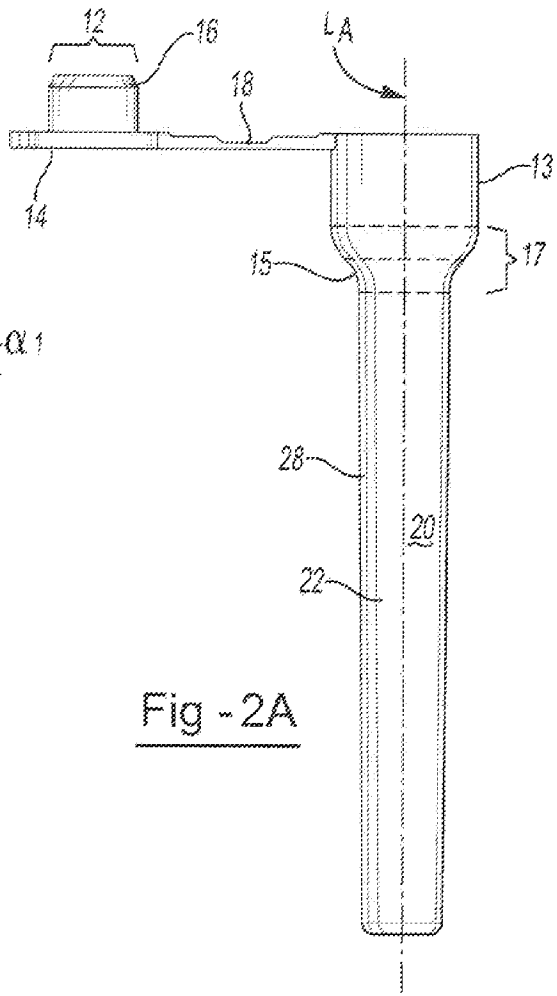
FIG. 2*a* is a side profile view of the tube of FIG. 1.

The present teachings pertain generally to an improved tube structure that exhibits relatively good heat exchange performance. The tube structure thus finds particularly attractive utility for polymerase chain reaction nucleic acid amplification protocols that employ repeated thermal cycling between hotter and cooler temperatures. The tube structure employs a relatively thin wall sample holding portion. In certain preferred aspects of the teachings, the tube structure employs a resiliently deformable structure that allows the tube to achieve intimate thermal communication (e.g., direct contacting communication) with a sample block that is the object of rapid heating and cooling.

Accordingly, in one aspect of the teachings there is contemplated a tube, and particularly a miniature tube for holding relatively small volumes of a material (such as no more than about 0.2 milliliters (ml) of a fluidic material (e.g., a capacity of no more than about 0.18 ml)), which makes the tube particularly attractive for use as a sample tube, and more specifically a biological sample tube. The tube may be configured to include a closure portion (which itself may include a tab portion, and an adjoining plug portion), a strap integrally connected to the closure portion and being configured for defining a living hinge, and a body portion. The body portion desirably has a longitudinal axis and an outer wall generally circumscribing the longitudinal axis. The body portion may be integrally and hingedly connected with the closure portion by way of the strap. The body portion may include a head portion that has an opening through which a sample is dispensed. The head portion may adjoin a sample portion of the body portion at a juncture (e.g., a neck that has a continuously variable slope around its circumference). The sample portion may have a first outer wall dimension and may include a closed distal end and a wall structure that includes an outer wall and an inner wall structure that defines a hollow cavity within which the sample (or any other material) resides as a sample volume after it is received through the head portion. The closed-ended hollow sample portion may be generally elongated along the longitudinal axis and desirably will be configured for elastic deformation along at least a portion of its length, including in a direction that is generally transverse to the longitudinal axis so that at least a portion of the wall structure compressively and resiliently deforms and engages a wall defining an opening in a sample block of a polymerase chain reaction amplification device. Upon such deformation the first outer wall dimension of the sample portion may be reduced (e.g., with a sample located therein) to a smaller second outer wall dimension.

The head portion may be dimensioned for frictionally engaging the closure portion. For example, the head portion may be dimensioned for frictionally engaging the closure portion and engaging the closure portion by way of a snap-fit or friction fit. The closure portion may be separately formed from the tube and/or separately attached to the tube. The head portion may be generally cylindrical. The head portion may be circular in shape or may be generally oval in shape. It may be generally tubular. It may have a substantially constant wall thickness along its length, about its circumference, or both. The head portion may have a generally circular transverse cross-section along its length that has an inner diameter of about 3 to about 4 mm. The head portion may have a generally oval transverse cross-section along its length that has an inner diameter of about 3 to about 4 mm. The head portion may have a generally circular outer diameter. The head portion may have a generally oval outer diameter. It may have an outer diameter of less than about 7 mm (e.g., about 5.5 to about 6.5 mm). The head portion may be formed for pipette loading. The head portion may be formed so that it has sufficient space to receive air pressure formed upon compression of the sample portion of the tube. The head portion may be located adjacent an intermediate portion (e.g., a juncture).

The intermediate portion may be located between the head portion and sample portion. The diameter of the tube may increase in moving from the sample portion to the head portion such that the intermediate portion comprises the portion of the tube where the diameter expands rapidly. The intermediate portion may have a continuously variable slope around its circumference. The intermediate portion may have a constant around its circumference. The intermediate portion may define a neck having a tapered wall of one or more slopes as evidenced by multiple angles relative to the bottom of the intermediate portion where it intersects with the sample portion. The slopes may gradually and continually vary around the circumference of the neck portion. The intermediate portion may be integrally formed with the sample portion and head portion and may also include a smooth surface with no attachments or extensions.

Figure 19:
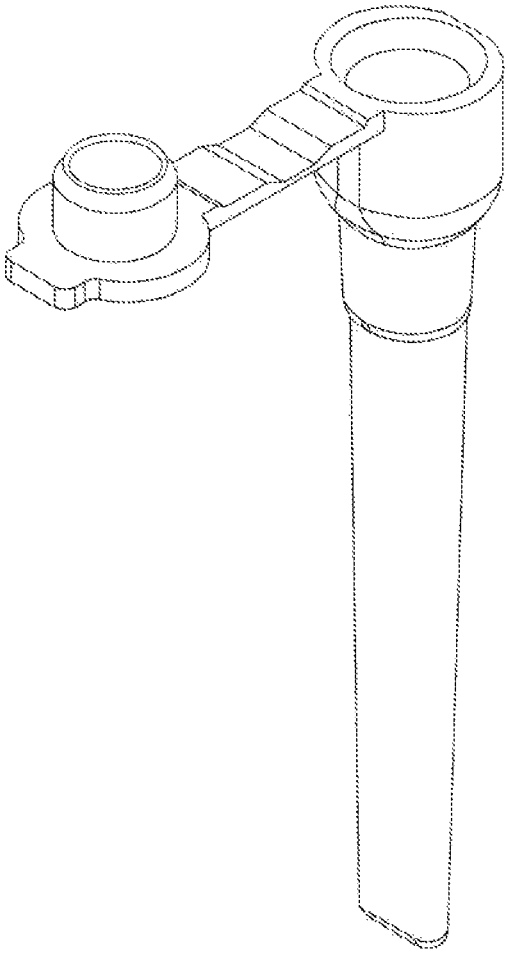
FIG. 19 is a perspective view of an illustrative example of a tube including a stop feature in accordance with the present teachings.
Figure 20:
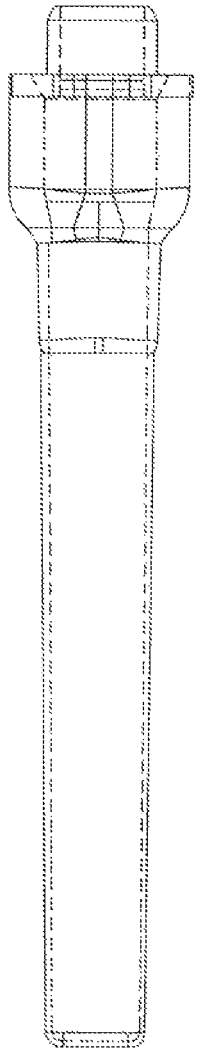
FIG. 20 is a front view of the tube of FIG. 19.
Figure 21:
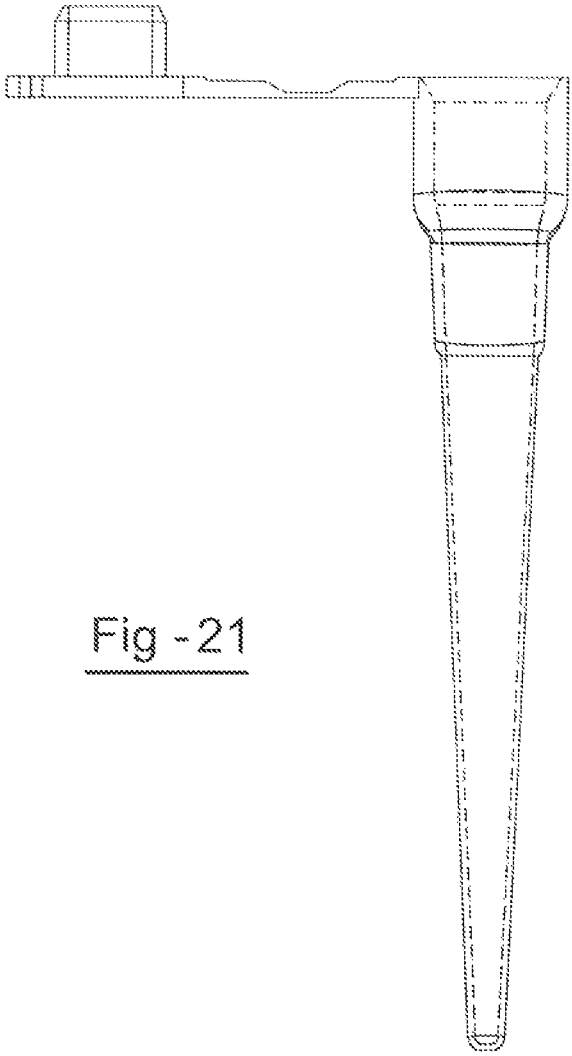
FIG. 21 is a side profile view of the tube of FIG. 19.
Figure 22:
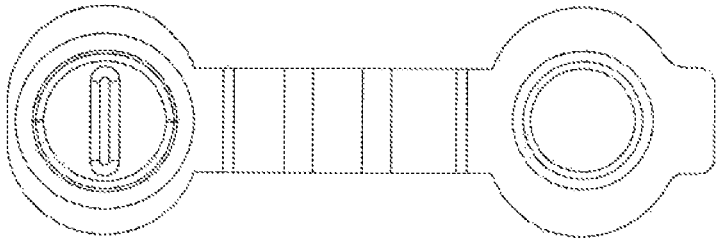
FIG. 22 is a top down view of the tube of FIG. 19.

Alternatively, the intermediate portion may be formed so that at least a portion of the tube is prevented from entering an opening in a sample block of a thermocycler. More specifically, as shown for example in FIGS. 19-21, the intermediate portion may define a neck having a diameter that exceeds the diameter of the sample portion so that the neck is prevented from entering an opening in a sample block. The intermediate portion may thus be formed to include a feature or attachment that acts as a stop to prevent the sample tube from entering into a sample block further than desired.

The sample portion may have a length that is longer than that of the head portion. For example, the sample portion may have a length that is greater than the length of the head portion by a factor of at least about 6. The length of the sample portion may be at least about 20 mm. For example, it may be about 25 to about 35 mm (e.g., about 30 mm). The sample portion may have a width in an open, non-compressed state, of about 2.0 mm.

The sample portion, along substantially the entirety of its length, may have a transverse cross-section outer profile that includes a transverse minor axis and a transverse major axis. The sample portion may have an outer profile that tapers along the longitudinal axis so that it narrows as it approaches the closed end of the tube (e.g., the end opposing the head portion). For example, the sample portion may have an outer profile that tapers generally continually along substantially the entirety of the length of the sample portion so that it narrows in at least one axis transverse to the longitudinal axis from a first outer wall dimension to a second outer wall dimension that is less than about one half (e.g., about one third) of the first outer wall dimension as it approaches the closed end of the tube.

The sample portion may be defined by an interior wall that has a generally oval cross section in a direction transverse to the longitudinal axis, for substantially the entirety of the length of the closed-ended hollow sample portion. By way of example, the sample portion may be defined by an interior wall that has a generally oval cross section that includes a minor axis and a major axis that is generally perpendicular to the minor axis, with each axes being oriented in a direction transverse to the longitudinal axis and having a dimension, for substantially the entirety of the length of the closed-ended hollow sample portion. The ratio of the dimensions of the minor axis to the major axis at a location where the head portion adjoins the sample portion may be about 1:2 to about 1:3.5. The minor-axis may have a dimension of about 1 mm at the distal end. The minor axis may have a dimension of about 2 mm along at least a portion of the sample portion.

Substantially along the length of the sample portion, the tube may have a wall thickness of about 0.05 to about 0.2 mm. The distal end may have a wall thickness that is greater than the wall thickness along the length of the sample portion by an amount of at least about twice. The distal end may have a wall thickness that is greater than the wall thickness along the length of the sample portion by an amount of about 10 times or less. At about the distal end, the tube may be tapered to a width of about 1.25 mm.

The outer wall of the sample portion may continuously taper at a substantially constant slope. Such taper may occur along substantially the entire length of the sample portion. The sample portion continuously tapers at a substantially constant slope over a length of about 25 to about 32 mm (e.g., about 30 mm).

The sample portion may include a generally optically transparent portion so that a reaction taking place within the sample portion can be monitored optically through the closed end. The generally optically transparent portion may be structured and/or function as a lens. The closure portion and/or walls of the tube may be optically clear. The closure portion may be optically clear, or only a portion of the closure portion may be optically clear. The sample tube may be made of a generally optically transparent polymeric material (e.g., polypropylene). The sample tube may be substantially free of any electrically conductive material, including any electrically conductive polymer. By way of example, the sample tube may be made of a polypropylene that is sufficiently optically transparent over at least a portion of its length, so that a reaction taking place within the sample portion can be monitored optically. A region including the distal end may be sufficiently optically transparent, so that a reaction taking place within the sample portion can be monitored optically.

As can be appreciated, the sample tuba portion may thus be configured so that during the compressive engagement an interior volume per unit length of the sample tube portion at the region proximate the distal end does not exceed an interior volume per unit length of the sample tube located more proximate to the head portion. The sample tube may be configured so that, during the compressive engagement, any deflection of the sample portion occurs relative to a generally fixed pivot region. The sample tube may be configured so that, during the compressive engagement, any deflection of the sample portion occurs relative to a generally fixed pivot region and the amount of angular deflection is less than about 45° relative to the longitudinal axis. The sample tube may be configured so that, during the compressive engagement, any deflection of the sample portion occurs relative to a generally fixed pivot region and the amount of angular deflection is less than about 90° relative to the longitudinal axis. The sample tube may be configured so that, during the compressive engagement, any deflection of the sample portion occurs relative to a generally fixed pivot region and the amount of angular deflection is less than about 15° relative to the longitudinal axis. The sample tube may be configured so that, during the compressive engagement, direct contact between opposing inner wall portions of the sample portion is avoided. Alternatively, during the compressive engagement, direct contact between opposing inner wall portions of the sample portion may occur and may promote sufficient heating and cooling cycles of a sample. The sample tube may be configured so that, during the compressive engagement, the closure remains in a closed and substantially sealed relationship with the head portion.

The teachings herein also contemplate methods of making a tube. According to one method it is envisioned that the tube is made by a method that includes a step of injection molding a polymeric material into a mold. Another possible method includes a step of fusing two or more pre-formed portions of the tube together to define the tube. The method may include a step of extruding the sample portion and then fusing the extruded sample portion with the head portion. The distal end may also be fused to form the closed distal end. As can be seen, such as when molded, the entire tube may be a unitary molded body that is free of any fusion joint. It is possible, such as when a fusing step is used, that the entire tube may be a unitary body that includes the head portion and the sample portion that include a fusion joint between them.

The present teachings also contemplate use of a tube as described. For example, the tubes herein may be employed to receive a quantity of a material. The material may be a biological specimen. Thus, it is possible that the tubes herein are employed to receive a sample for nucleic acid (e.g., DNA and/or RNA) amplification. The nucleic acid amplification may be performed in a thermocycler. For example, the tubes herein may be employed to amplify a sample for nucleic acid amplification in a thermocycler that has a sample block (optionally a solid metal sample block, such as a silver sample block) that includes at least one bore defined by a wall having a generally oval transverse section along at least a portion of its length. An example of one suitable thermocycler is described in commonly owned and co-pending U.S. application Ser. No. 12/918,914. The tubes may be employed in a step of inserting the tubes into a thermal block having one or a plurality of bores therein so that contact with the walls causes the tubes to resiliently deform (such deformation may be temporary or permanent) so that heat exchange within the tube is more efficient than in the original configuration (e.g., prior to deformation) that received the sample.

Figure 1:
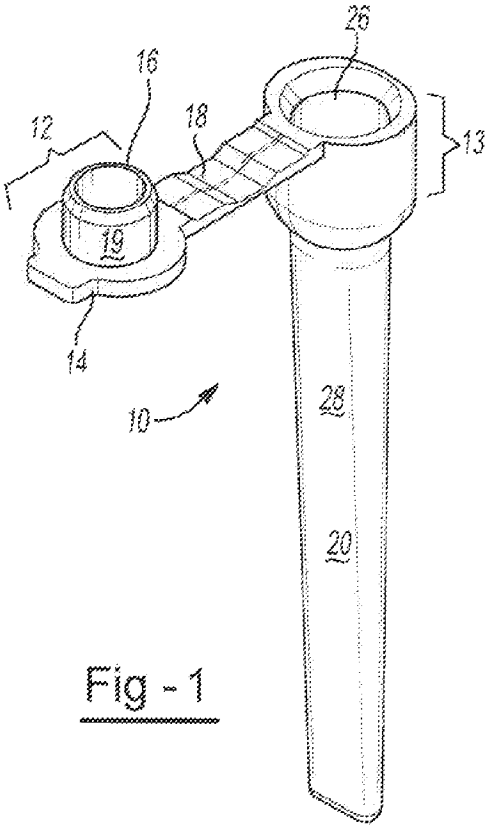
FIG. 1 is a perspective view of an illustrative example of the tube of the present invention.

Turning now to the drawings to illustrate examples of embodiments of the present teachings. As shown for example in FIGS. 1 and 2B, a sample tube 10 is shown having a closure portion 12 (which itself may include a tab portion 14, and an adjoining plug portion 16). A strap 18 integrally connects to the closure portion 12 and is configured for defining a living hinge. The tube includes a head portion 13 to which the closure portion 12 is attached via the strap 18. In the open position (e.g., when the closure is not located within the head portion), the closure portion and head portion may combine to form a width (W) that includes the combined width of the closure portion 12, strap 18, and head portion 13. The closure portion 12 may have a side wall 19 that matingly engages an inner wall of the head portion 13. The side wall 19 may have a length of about 2.5 mm. The side wall 19 may be slightly angled (e.g., about 2°) relative to the longitudinal axis. An intermediate portion 17 may be located in between the head portion 13 and body portion 28. The intermediate portion 17 may define a neck 15 having a tapered wall of one or more slopes as evidenced by angles (e.g., $\alpha$1, $\alpha$2) relative to the bottom of the intermediate portion 17 where it intersects with a sample portion 28. The slopes may gradually and continually vary around the circumference of the neck portion. The body portion 20 has a longitudinal axis (LA) and an outer wall 22 generally circumscribing the longitudinal axis. The body portion 20 is integrally and hingedly connected with the closure portion 12 by way of the strap 18. The body portion includes the head portion 13 that has an opening 26 through which a sample is dispensed and/or received, and a sample portion 28 having a first outer wall dimension (OWD1) (as shown at FIG. 4*a*). The sample portion includes a closed distal end 30 and a wall structure 32 that includes an outer wall 34 and an inner wall 36 that defines a hollow cavity 38, within which the sample resides as a sample volume after is dispensed through the head portion. As seen, the closed-ended hollow sample portion is generally elongated along the longitudinal axis.

Figure 4B:
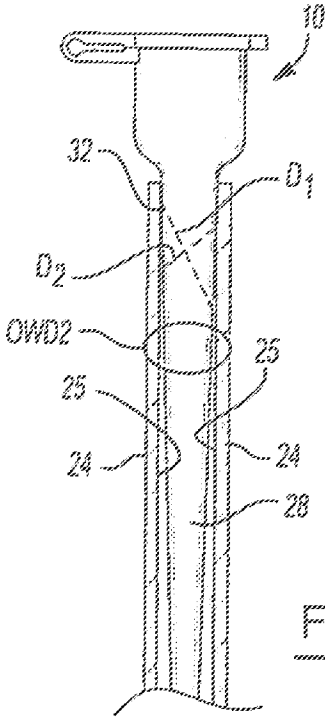
FIG. 4*b* is a cross-sectional view of the sample block of FIG. 4A showing the tube of FIG. 1 fully inserted into a sample block opening.
Figure 4A:
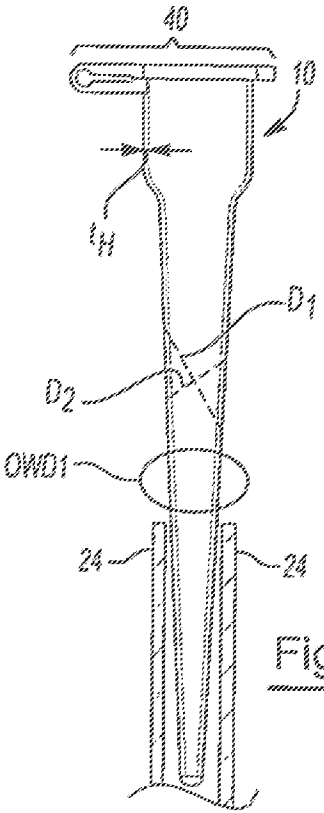
FIG. 4*a* is a cross-sectional view of an illustrative example of a sample block showing the tube of FIG. 1 partially inserted into a sample block opening.

With reference to FIGS. 4*a* and 4*b*, it is also seen how at least the sample portion is configured for elastic deformation along a portion of its length. FIG. 4*a* shows the tube prior to deformation by insertion into a sample block 24, while FIG. 4*b* shows the tube upon deformation when inserted into the sample block 24. Specifically, FIG. 4*b* illustrates how, when a force is applied to the tube from a direction that is generally transverse to the longitudinal axis (such as a force realized when inserting such tube into an opening of a sample block 24), at least a portion of the wall structure 32 compressively and resiliently deforms and engages a wall 25 defining the opening in the sample block. The first outer wall dimension of the sample portion reduces to a smaller second outer wall dimension (OWD2). During compression, a first internal diameter ($D_1$) across the tube may increase, while a second internal diameter ($D_2$) that lies perpendicular to the first diameter may decrease.

Figure 3:
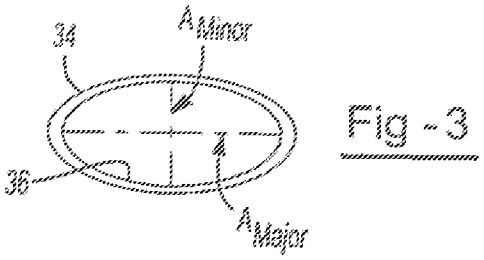
FIG. 3 is a top-down view of the tube of FIG. 1 showing the major and minor diameters within the tube.

As, seen, the head portion, frictionally engages the closure by way of a snap-fit connection structure 40. The head portion may have a substantially constant wall, thickness ($t_H$) along its length, about its circumference, or both. As shown for example in FIG. 3, the body portion may have a generally oval transverse cross-section along its length that has a major axis ($A_{major}$) and a minor axis ($A_{minor}$). The major axis may have a dimension of about 3 to about 4 mm. The minor axis may have a dimension of about 1.5 to about 2.5 mm. During compression, a first axis (e.g., the minor axis) width may decrease while a second axis (e.g., the major axis) width may increase.

Figure 5:
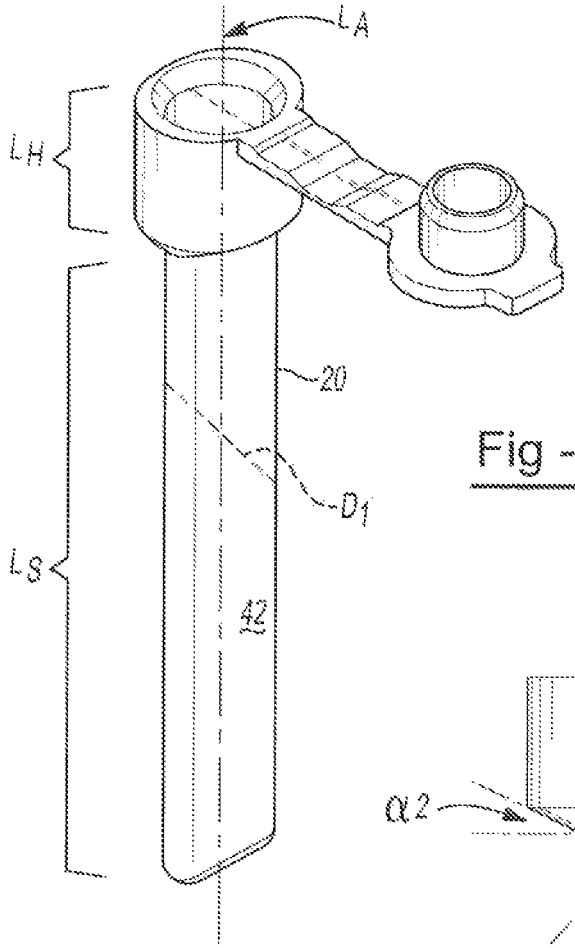
FIG. 5 is a perspective view of an illustrative example of the tube of the present invention.
Figure 6:
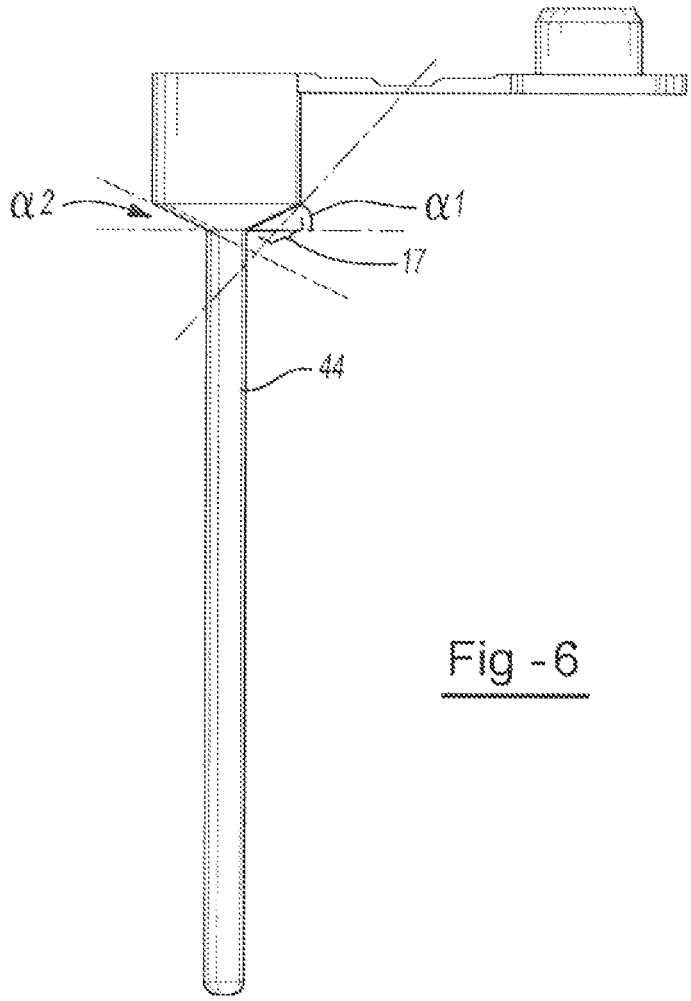
FIG. 6 is a side profile view of the tube of FIG. 5.

As shown in FIGS. 5 and 6, the sample portion may have a length ($L_S$) that is longer than the length ($L_H$) of the head portion. For example, the sample portion may have a length that is greater than the length of the head portion by a factor of at least about 6. The length of the sample portion may be at least about 20 mm. For example, it may be about 25 to about 35 mm (e.g., about 30 mm).

Figure 2B:
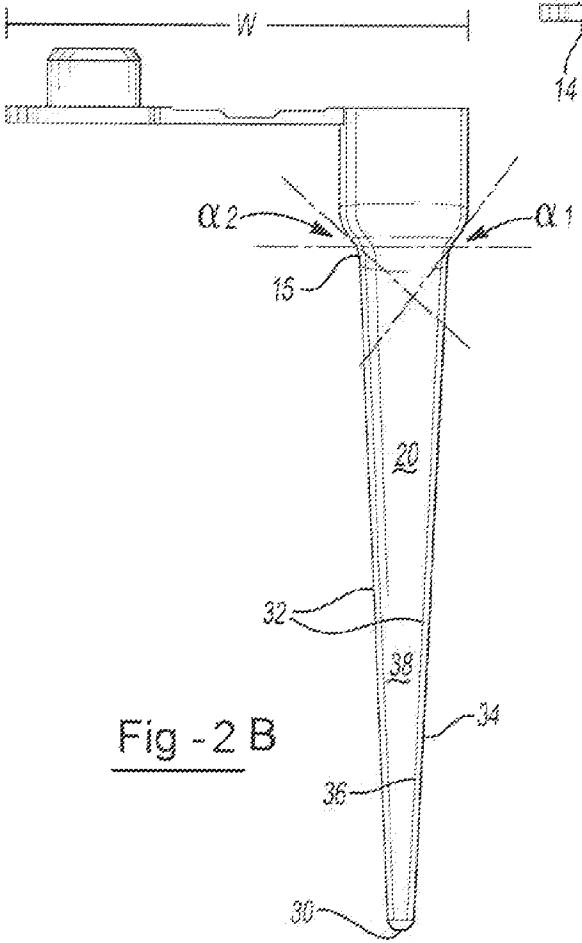
FIG. 2*b* is a front view of the tube of FIG. 1.

As seen, the sample portion has an outer profile that tapers along the longitudinal axis so that it narrows as it approaches, the closed end of the tube. As shown in FIG. 2B, the sample portion may have an outer profile that tapers generally continually along substantially the entirety of the length of the sample portion. The dimension of the minor axis reduces from its original dimension at the juncture between the head portion and the sample portion to about one third of the original dimension at the juncture as it approaches the closed end of the tube. The ratio of the dimensions of the minor axis to the major axis at juncture location where the head portion adjoins the sample portion may be about 1:2 to about 1:3.5. The minor axis has a dimension of about 1 mm at the distal end. At the region about the distal end, the outer wall of the tube may be tapered to a width of about 1.25 mm.

Substantially along the length of the sample portion, the tube may have a wall thickness of about 0.05 to about 0.2 mm. The distal end may have a wall thickness that is greater than the wall thickness along the length of the sample portion by an amount of at least about twice. The distal end may have a wall thickness that is greater than the wall thickness along the length of the sample portion by an amount of about 10 times or less. The distal end may have a wall thickness that is substantially the same as the wall thickness along the sample portion.

As seen in FIG. 2B, both the outer wall 34 and the inner wall 36 (which are shown as being generally parallel) of the sample portion may continuously taper at a substantially constant slope. Such taper may occur substantially the entire length of the sample portion. The sample portion continuously tapers at a substantially constant slope over a length of about 25 to about 30 mm (e.g., about 28 mm).

With reference to FIG. 4B, the sample tube portion is configured so that during a compressive engagement an interior volume per unit length of the sample portion 28 at the region proximate the distal end does not exceed an interior volume per unit length of the sample tube located more proximate to the head portion. The sample tube is also configured so that, during the compressive engagement, any deflection of the sample portion occurs relative to a generally fixed pivot region (e.g., a region located between the distal end and the location where the outer wall of the sample portion contacts a sample block). Any deflection of the sample portion may therefore occur relative to the generally fixed pivot region and the amount of angular deflection is less than about 45° relative to the longitudinal axis. Any deflection of the sample portion may therefore occur relative to the generally fixed pivot region and the amount of angular deflection is less than about 90° relative to the longitudinal axis. Any deflection of the sample portion may therefore occur relative to the generally fixed pivot region and the amount of angular deflection is less than about 15° relative to the longitudinal axis. Further, as can be seen from FIG. 4B, the sample tube is configured so that, during the compressive engagement, direct contact between opposing inner wall portions of the sample portion is avoided. Alternatively, during the compressive engagement, direct contact between opposing inner wall portions of the sample portion may occur.

Figure 7:
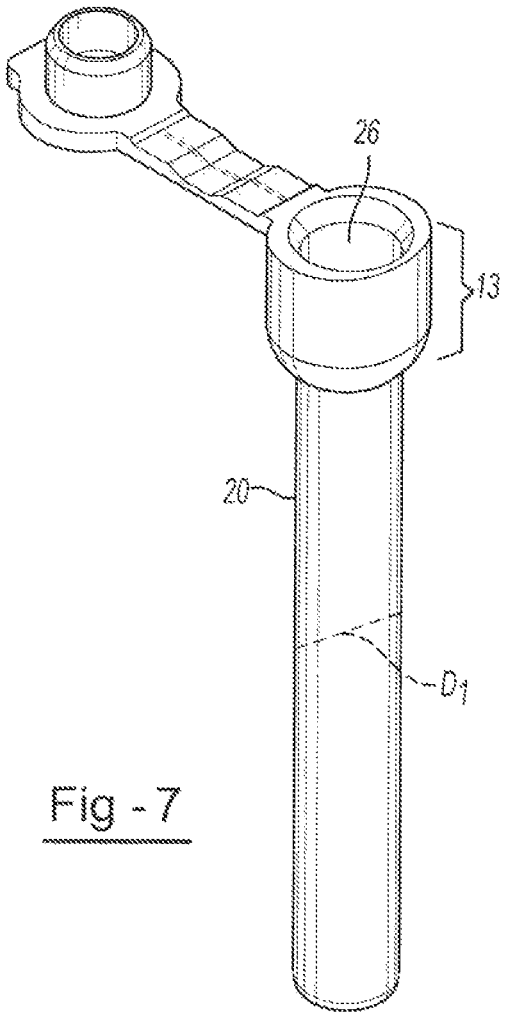
FIG. 7 is a perspective view of an illustrative example of the tube of the present invention.
Figure 8:
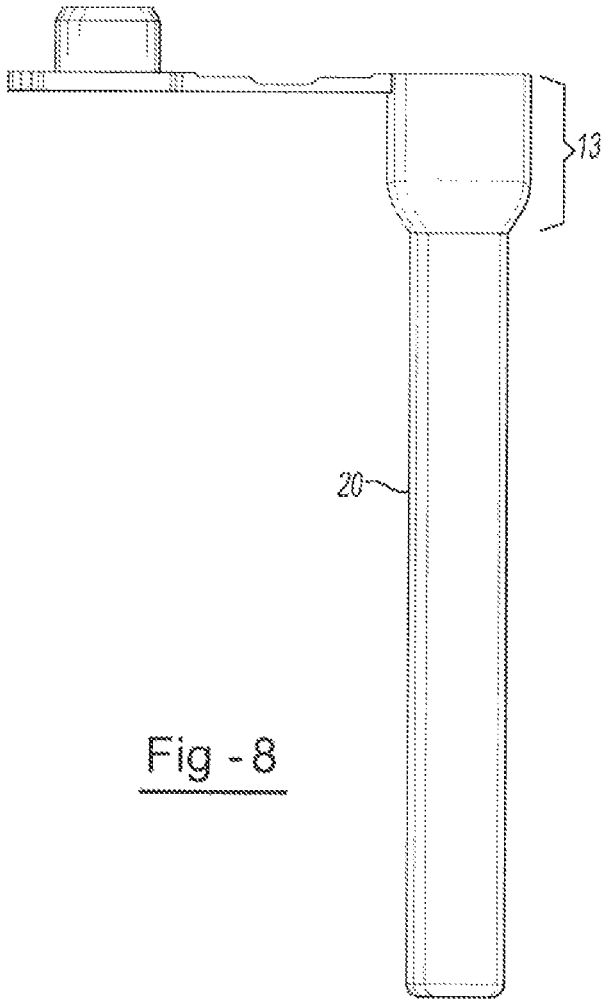
FIG. 8 is a side profile view of the tube of FIG. 7.
Figure 9:
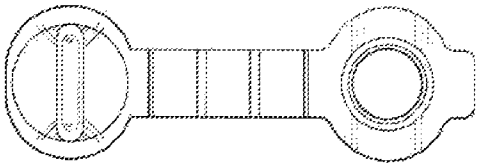
FIG. 9 is a top down view of the tube of FIG. 5.
Figure 11:
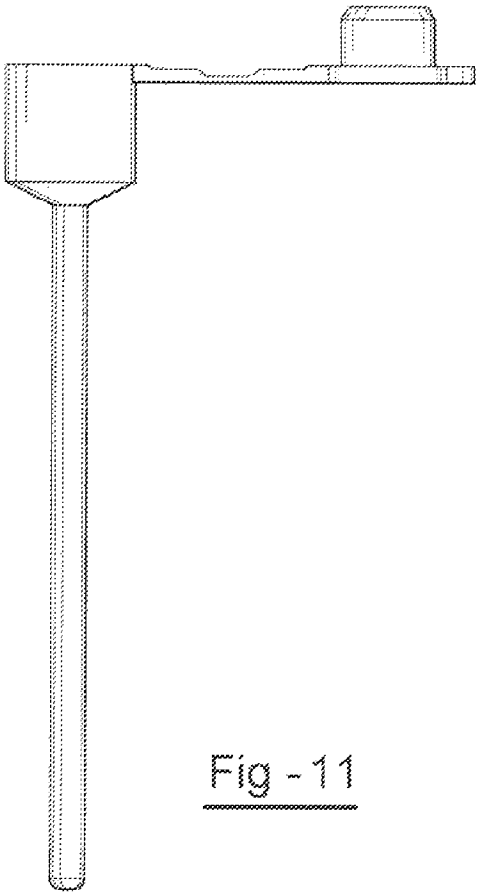
FIG. 11 is a side profile view of the tube of FIG. 5.
Figure 12:
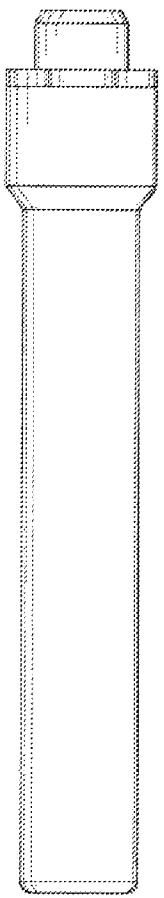
FIG. 12 is a front view of the tube of FIG. 5.
Figure 10:
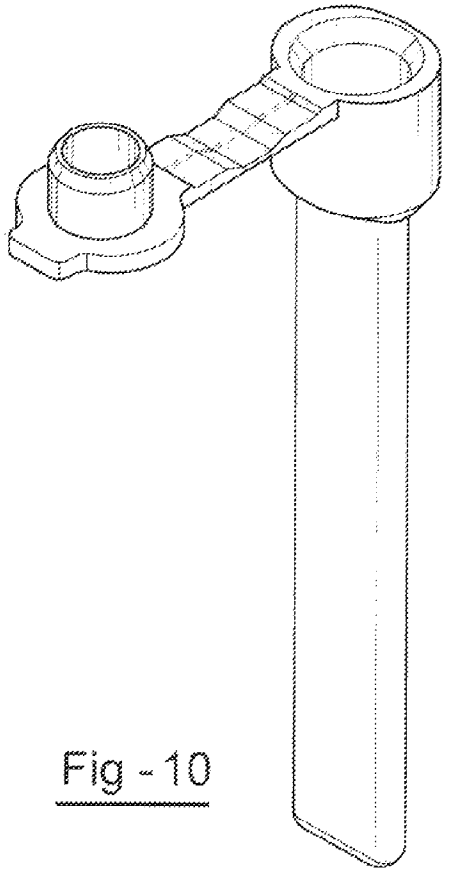
FIG. 10 is a perspective view of the tube of FIG. 5.
Figure 15:
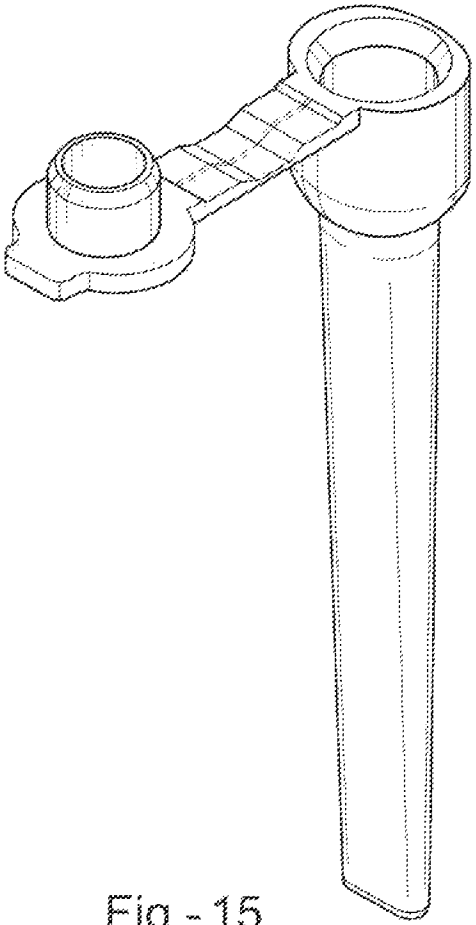
FIG. 15 is a perspective view of the tub of FIG. 1.
Figure 14:
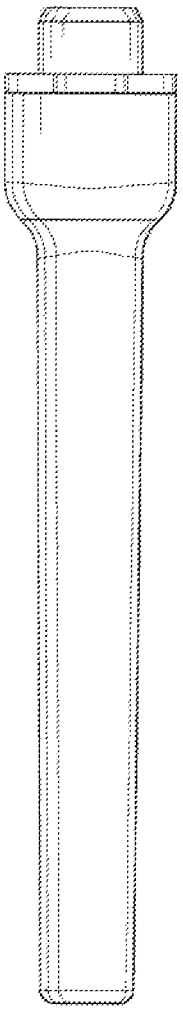
FIG. 14 is a front view of the tube of FIG. 1.
Figure 13:
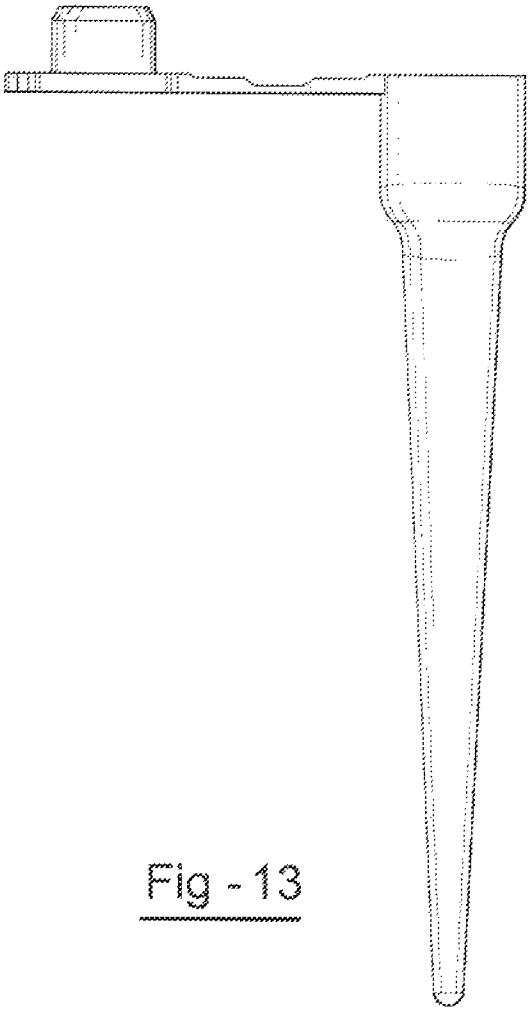
FIG. 13 is a side profile view of the tube of FIG. 1.
Figure 18:
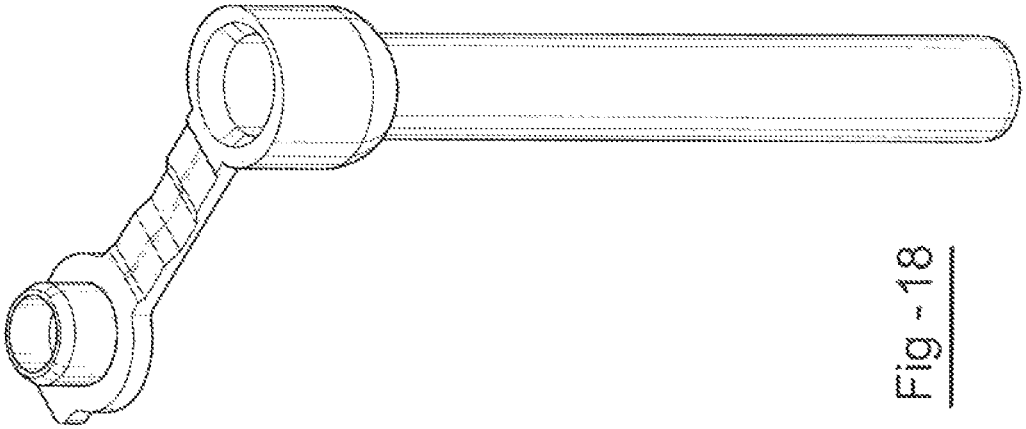
FIG. 18 is a perspective view of the tube of FIG. 7.
Figure 17:
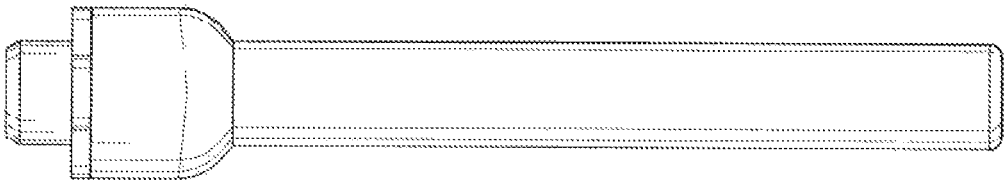
FIG. 17 is a rear view of the tube of FIG. 7.
Figure 16:
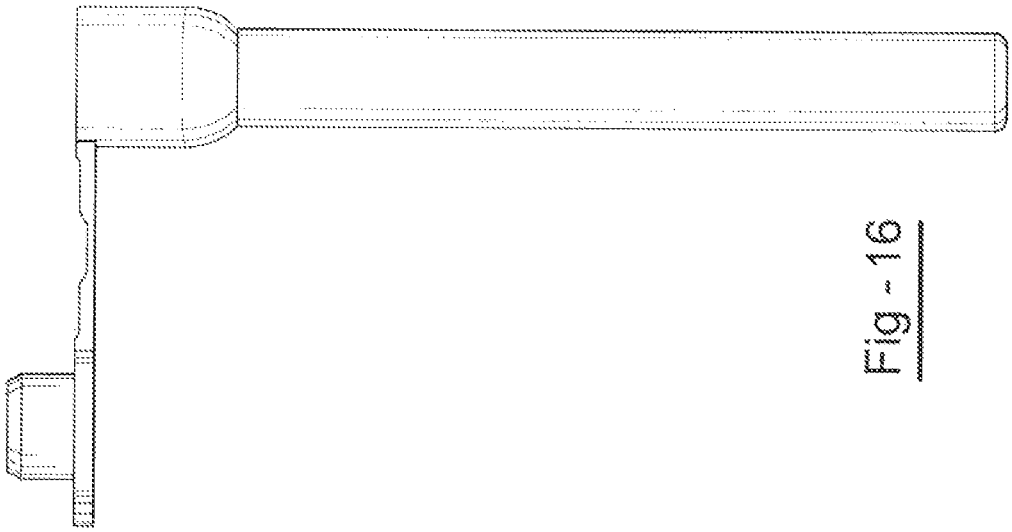
FIG. 16 is a front view of the tube of FIG. 7.

Further embodiments of the tubes are shown at FIG. 5-8. As shown in FIGS. 5 and 6, the sample portion 28 may have a substantially constant cross section along the longitudinal axis (LA), such that the diameter of the tube $D_1$ remains constant along the sample portion. Further, the sample portion 28 may include opposing substantially flat walls 42 and opposing substantially curved walls 44. As shown for Example at FIG. 6, the intermediate portion 17 may define a neck having a tapered wall of one or more slopes as evidenced by angles (e.g., $\alpha$1, $\alpha$2) relative to the bottom of the intermediate portion where it intersects with the body portion 28. Alternatively, as shown in FIGS. 7 and 8, the sample portion 28 may form a substantially cylindrical opening, such that the diameter of the sample portion ($D_1$) remains constant along the length of the length of the sample portion. The opening 26 of the head portion 13 may be circular such that the shape of the opening 26 is consistent with the shape of the sample portion 28.

Additional embodiments of the tube are shown at FIGS. 9-18. The dimensions shown in the drawings are incorporated by reference herein as illustrative examples of the teachings. The relative proportions shown in the drawings are likewise incorporated by reference herein even if not expressly recited in this description. For example, the drawings illustrate a ratio of a length of the sample portion the a length of the head portion of approximately 6:1 so that such a ratio is considered to be within the scope of the teachings herein. The ratio of a length of the sample portion the a length of the head portion may be approximately 3:1, 2:1 or 1:1. The teachings are not limited solely to the embodiments and dimensions shown in the drawings.

The head portion is preferably integrally formed with the sample portion so that both the head portion and sample portion have a smooth surface with the only attachment or projection extending from either the head portion or sample portion being the closure portion. The head portion and sample portion may be integrally formed, but may be formed with a feature located intermediate the head portion and sample portion that acts as a stop to assist in locating the tube in a desired location within an opening during use. The diameter of the tube may expand in moving from the sample portion to the head portion to form the intermediate portion. The sample portion, the head portion, the closure portion or any combination thereof may be formed of a single layer of polymeric material. The closed end of the tube may be circular in shape, ovoid in shape, conical in shape, or substantially rectangular in shape. The tube may be substantially free of a triangular shaped closed end. The interior of the sample portion may form a smooth surface containing no additional elements (e.g., openings, receptacles, vessels, extensions, attachments, ridges) within the sample portion. The exterior of the sample portion may form a smooth surface containing no additional elements (e.g.; openings, receptacles, vessels, extensions, attachments, ridges) within the sample portion. The sample portion may also be substantially free of any openings (e.g., ports). The sample portion may include only flexible walls and may be free of any rigid walls or rigid wall portions. The sample portion may include only rigid walls and may be free of any flexible walls or flexible wall portions.

When the closure portion is located into the sample portion to seal the tube, the top of the closure portion may be substantially flat with no attachments or extensions located on the closure portion. The closure portion may include a membrane located thereon to allow for access into the tube. Alternatively, the closure portion may be substantially free of any membrane. The closure portion may have an open position and a closed position. The closure portion may also be substantially free of any moving parts. More specifically, the closure portion may be substantially free of any parts to assist the closure portion in securely closing the tube. The strap connecting the closure portion to the head portion is preferably flexible with no means for securing the head portion in an open position or partially open position. The strap portion may also be free of substantial rigidity such that the strap will be unable to support the tube if any attempt is made to rest the tube on the strap or closure portion. More specifically, the tube may be free of any mechanism by which the tube can be supported in an upright position without the assistance of a separate holder. The head portion may include a textured surface. The textured surface may be adapted to receive printed or written information to identify patient information for a sample received within the tube.

The tube may be a fixed oval shape which may not be deformable. The sample portion may be substantially free of defined edges. The sample portion may receive non-biological. The sample portion may receive identifying information, which may include an RFID code. The head portion may be substantially rigid so that it does not deform.

As to all of the foregoing general teachings, as used herein, unless otherwise stated, the teachings envision that any member of a genus (list) may be excluded from the genus; and/or any member of a Markush grouping may be excluded from the grouping.

Unless otherwise stated, any numerical values recited herein include all values from the lower value to the upper value in increments of one unit provided that there is a separation of at least 2 units between any lower value and any higher value. As an example, if it is stated that the amount of a component, a property, or a value of a process variable such as, for example, temperature, pressure, time and the like is, for example, from 1 to 90, preferably from 20 to 80, more preferably from 30 to 70, it is intended that intermediate range values such as (for example, 15 to 85, 22 to 68, 43 to 51, 30 to 32 etc.) are within the teachings of this specification. Likewise, individual intermediate values are also within the present teachings. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the Detailed Description of the Invention of a range in terms of at "'x' parts by weight of the resulting polymeric blend composition" also contemplates a teaching of ranges of same recited amount of "x" in percent by weight of the resulting polymeric blend composition."

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints. Concentrations of ingredients identified in Tables herein may vary ±10%, or even 20% or more and remain within the teachings.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of, or even consist of the elements, ingredients, components or steps. Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full-scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

What is claimed is:

1. A polymeric sample tube and sample holder, comprising:

a. a closure portion, b. a strap integrally connected to the closure portion and being configured for defining a living hinge;

c. a body portion having a longitudinal axis and an outer wall generally circumscribing the longitudinal axis, and being integrally and hingedly connected with the closure portion by way of the strap, the body portion including a head portion that has an opening through which a sample is dispensed, a sample portion having a first outer wall dimension and including a closed distal end being elliptical and flat in shape and a wall structure that includes an outer wall and an inner wall structure that defines a hollow cavity within which the sample resides as a sample volume after is dispensed through the head portion, the closed-ended hollow sample portion being generally elongated along the longitudinal axis and being configured for elastic deformation along a portion of its length, including in a direction that is generally transverse to the longitudinal axis so that at least a portion of the wall structure compressively and resiliently deforms upon insertion to a sample block as a result of the tube having a wall thickness of about 3.05 to about 0.2 mm, and an intermediate portion joining the head portion and the sample portion, the intermediate portion being defined by a neck having a tapered wall of one or more slopes forming one or more angles relative to a bottom of the intermediate portion where it intersects with the sample portion;

wherein the sample portion has an outer profile that tapers generally continually along substantially the entirety of the length of the sample portion so that it narrows in at least one axis transverse to the longitudinal axis as it approaches the closed end of the tube.

2. The sample tube and sample holder of claim 1, wherein the closure portion includes a tab portion, and an adjoining plug portion.

3. The sample tube and sample holder of claim 1, wherein the head portion is dimensioned for frictionally engaging the closure portion.

4. The sample tube and sample holder of claim 1, wherein the head portion is dimensioned for frictionally engaging the closure portion and engaging the closure portion by way of a snap-fit.

5. The sample tube and sample holder of claim 1, wherein the head portion is generally cylindrical.

6. The sample tube and sample holder of claim 1, wherein the sample portion has a length that is greater than the length of the head portion by a factor of at least about 3.

7. The sample tube and sample holder of claim 1, wherein the sample portion, along substantially the entirety of its length, has a transverse cross-section outer profile that includes a transverse minor axis and a transverse major axis.

8. The sample tube and sample holder of claim 1, wherein the closed-ended hollow sample portion has an outer profile that tapers along the longitudinal axis so that it narrows as it approaches the closed end of the tube.

9. The sample tube and sample holder of claim 1, wherein the sample portion is defined by an interior wall that has a generally oval cross section in a direction transverse to the longitudinal axis, for substantially the entirety of the length of the closed-ended hollow sample portion.

10. The sample tube and sample holder of claim 1, wherein the sample portion is defined by an interior wall that has a generally oval cross section that includes a minor axis and a major axis that is generally perpendicular to the minor axis, with each axes being oriented in a direction transverse to the longitudinal axis and having a dimension, for substantially the entirety of the length of the closed-ended hollow sample portion.

11. The sample tube and sample holder of claim 10, wherein the ratio of the dimensions of the minor axis to the major axis at a location where the head portion adjoins the sample portion is about 1:2 to about 1:3.5.

12. The sample tube and sample holder of claim 10, wherein the minor axis has a dimension of about 1 mm at the distal end.

13. The sample tube and sample holder of claim 1, wherein substantially along the length of the sample portion, the tube has a wall thickness of about 0.05 to about 0.2 mm, and the distal end has a wall thickness that is greater than the wall thickness along the length of the sample portion by an amount of at least about twice and about ten times or less.

14. The sample tube and sample holder of claim 1, wherein at about the distal end, the tube is tapered to a width of about 1.25 mm.

15. The sample tube and sample holder of claim 1, wherein the head portion has a generally circular transverse cross-section along its length that has an inner diameter of about 3 to about 4 mm.

16. The sample tube and sample holder of claim 1, wherein the head portion has a generally oval outer transverse cross-section and generally round inner transverse cross section along its length that has an inner diameter of about 3 to about 4 mm.

17. The sample tube and sample holder of claim 1, wherein the sample tube is made of a polypropylene that is sufficiently optically transparent, so that a reaction taking place within the sample portion can be monitored optically.

18. The sample tube and sample holder of claim 1, wherein the distal end is sufficiently optically transparent, so that a reaction taking place within the sample portion can be monitored optically.

19. The sample tube and sample holder of claim 1, wherein the entire tube is a unitary molded body that is free of any fusion joint.

20. The sample tube and sample holder of claim 1, wherein the sample tube portion is configured so that during the compressive engagement with the openings of the sample holder an interior volume per unit length of the sample tube portion at the region proximate the distal end does not exceed an interior volume per unit length of the sample tube located more proximate to the head portion.

* * * * *

UNITED STATES PATENT AND TRADEMARK OFFICE

CERTIFICATE OF CORRECTION

PATENT NO. : 8,889,086 B2
APPLICATION NO. : 13/452419
DATED : November 18, 2014
INVENTOR(S) : Hendrik J. Viljoen It is certified that error appears in the above-identified patent and that said Letters Patent is hereby corrected as shown below:

In the Claims

Col. 11, Claim 1, Line 16, "3.05" should be "0.05"

Signed and Sealed this
Thirty-first Day of March, 2015

Michelle K. Lee

Michelle K. Lee
*Director of the United States Patent and Trademark Office*